US007854058B2

(12) United States Patent
Schreiber et al.

(10) Patent No.: US 7,854,058 B2
(45) Date of Patent: Dec. 21, 2010

(54) METHOD OF MAKING HIGH VOLTAGE OPERATING ROD SENSOR

(75) Inventors: Daniel Schreiber, New Berlin, WI (US); Veselin Skendzic, Pullman, WA (US); E. Fred Bestel, Mint Hill, NC (US); Paul N. Stoving, Oak Creek, WI (US); Richard A. Harthun, Eagle, WI (US)

(73) Assignee: Cooper Technologies Company, Houston, TX (US)

( * ) Notice: Subject to any disclaimer, the term of this patent is extended or adjusted under 35 U.S.C. 154(b) by 36 days.

(21) Appl. No.: 12/269,516

(22) Filed: Nov. 12, 2008

(65) Prior Publication Data

US 2009/0077793 A1 Mar. 26, 2009

Related U.S. Application Data

(62) Division of application No. 10/359,275, filed on Feb. 6, 2003, now Pat. No. 7,473,863.

(51) Int. Cl.
*H01H 11/00* (2006.01)
*H01H 65/00* (2006.01)

(52) U.S. Cl. ..... 29/622; 29/825; 29/846; 218/48; 218/120; 218/134; 218/138; 264/254; 264/272.11; 264/272.15

(58) Field of Classification Search ..... 29/622, 29/602, 1, 825, 846, 848, 850; 218/43, 48, 218/120, 134, 138, 140; 264/254, 255, 272.11, 264/272.15, 272.19
See application file for complete search history.

(56) References Cited

U.S. PATENT DOCUMENTS 4,150,270 A 4/1979 Zunick (Continued)

FOREIGN PATENT DOCUMENTS

DE 29723039 3/1998

(Continued)

OTHER PUBLICATIONS

Office Action and English-language translation thereof for corresponding Japanese application No. 2006-501137, mailed Apr. 1, 2008.

(Continued)

*Primary Examiner*—Thiem Phan
(74) *Attorney, Agent, or Firm*—Fish & Richardson P.C.

(57) ABSTRACT

Methods for making and using vacuum switching devices are disclosed. A vacuum switching device has an operating rod for actuating a movable electrical contact within the device. The operating rod may be a hollow epoxy glass tube with an electrical sensor disposed within it, and there may be an elastomeric polymer filling compound disposed within the tube and encasing the sensor. The operating rod may be attached to the movable electrical contact on one end by a steel end-fitting that has been press-fit into the tube and secured with at least one cross pin. In this way, a very secure electromechanical connection may be made between the operating rod and the rest of the vacuum switching device, and the sensor is protected from shock associated with the operation of the device. Moreover, the vacuum switching device is compact and easy to construct.

22 Claims, 4 Drawing Sheets

U.S. PATENT DOCUMENTS

| | | | | |
|---|---|---|---|---|
| 4,161,012 | A | | 7/1979 | Cunningham |
| 4,241,373 | A | | 12/1980 | Mara et al. |
| 5,252,913 | A | | 10/1993 | Falkowski et al. |
| 5,276,285 | A | | 1/1994 | Pham et al. |
| 5,585,611 | A | | 12/1996 | Harvey et al. |
| 5,698,831 | A | | 12/1997 | Abdelgawad et al. |
| 5,729,888 | A | | 3/1998 | Abdelgawad et al. |
| 5,808,258 | A | | 9/1998 | Luzzi |
| 5,864,942 | A | * | 2/1999 | Luzzi ..... 29/622 |
| 5,917,167 | A | | 6/1999 | Bestel |
| 6,239,399 | B1 | | 5/2001 | Perret |
| 6,331,687 | B1 | | 12/2001 | Dunk et al. |

FOREIGN PATENT DOCUMENTS

| | | |
|---|---|---|
| FR | 2442450 | 6/1980 |
| JP | 2-212781 | 8/1990 |

OTHER PUBLICATIONS

International Preliminary Report on Patentability and Written Opinion (Application No. PCT/US2004/003511), 5 pages, Aug. 25, 2005.
Supplementary European Search Report (Application No. 04709079.0-2214/PCT/US2004003511) dated Jun. 15, 2007 (5 total pages).
Examination Report (Communication pursuant to Article 96(2) EPC, European Application No. 04 709 079.0-2214 dated Sep. 10, 2007 (7 pages).

* cited by examiner

METHOD OF MAKING HIGH VOLTAGE OPERATING ROD SENSOR

CROSS REFERENCE TO RELATED APPLICATIONS

This application is a divisional of U.S. application Ser. No. 10/359,275, filed Feb. 6, 2003, which is incorporated herein by reference in its entirety.

TECHNICAL FIELD

This description relates to high voltage switchgear.

BACKGROUND

Conventional vacuum fault interrupters provide high voltage fault interruption. Such a vacuum fault interrupter, which also may be referred to as a vacuum interrupter, generally includes a stationary electrode assembly having an electrical contact, and a movable electrode assembly having its own electrical contact and arranged on a common longitudinal axis with respect to the stationary electrode assembly. The movable electrode assembly generally moves along the common longitudinal axis such that the electrical contacts come into and out of contact with one another. In this way, a vacuum interrupter placed in a current path can be used to interrupt excessively high current and thereby prevent damage to an external circuit.

To determine when to move the electrical contacts out of contact with one another, conventional vacuum interrupters often use some type of current and/or voltage-sensing device.

SUMMARY

In one general aspect, a vacuum switching device includes a vacuum assembly. Switching contacts are disposed within the vacuum assembly, and one of the switching contacts is a switching contact that is movable along an axis. The vacuum switching device also includes a rod disposed along the axis and operable to actuate movement of the movable switching contact along the axis, and a sensor disposed within the rod and encapsulated by a filling compound.

Implementations may include one or more of the following features. For example, the filling compound may be made of an elastomeric polymer compound. The sensor may include a resistive element, and the rod may include a radially-wound epoxy glass tube.

A metallic fitting may be press-fit into an end of the rod and connected to the sensor, and a cross pin may be inserted through the rod and the metallic fitting to hold the metallic fitting in place. In this implementation, a conductive guard sleeve may be electrically connected to the metallic fitting by the cross pin. Further, the metallic fitting may be grounded, so that the conductive guard sleeve is also grounded. Also, a voltage-sensing resistor may be electrically connected to the metallic end fitting via a pin socket assembly.

The rod may be encased in a ribbed silicone sleeve, and the device may include a vacuum fault interrupter.

In another general aspect, an operating rod for a vacuum switching device may be made by inserting a sensor into a hollow tube, connecting a first portion of the sensor to a first end fitting attached to a first end of the tube, connecting a second portion of the sensor to an electrical connection extending outside of the tube, and filling the tube with a filling compound.

Implementations may include one or more of the following features. For example, the filling compound may be an elastomeric polymer compound.

In inserting a sensor, a resistive element may be threaded through a length of the hollow tube. One end of the resistive element may be attached to a pin socket assembly attached to the first end fitting.

Also in inserting a sensor, at least one hole may be drilled through a portion of the tube near the first end of the tube, the first end fitting may be press-fit into the first end of the tube, and a pin may be inserted through the hole and into the first end fitting.

A ribbed rubber skirt may be pulled over the operating rod. The tube may be a radially-wound epoxy glass tube.

In filling the tube with the filling compound, the filling compound may be injected through the silicone rubber skirt and into the tube. Further, filling the tube with the filling compound may also include drilling a hole in the tube near the second end of the tube, standing the tube with the first end facing in a downward direction, and injecting the filling compound at a point near the first end, such that air displaced by the filling compound is removed from the tube through the hole. In this implementation, the hole may be used to facilitate formation of the electrical connection to the second portion of the sensor.

According to another general aspect, an operating rod for use in a vacuum switching device includes a radially-wound, epoxy glass tube, a sensor extending through a length of the tube, and a filling compound within the tube and encasing the sensor.

Implementations may include one or more of the following features. For example, a silicone sleeve may encase a first portion of the operating rod, and a grounded guard sleeve may be around a second portion of the operating rod.

The details of one or more implementations are set forth in the accompanying drawings and the description below. Other features will be apparent from the description and drawings, and from the claims.

DETAILED DESCRIPTION

Figure 1:
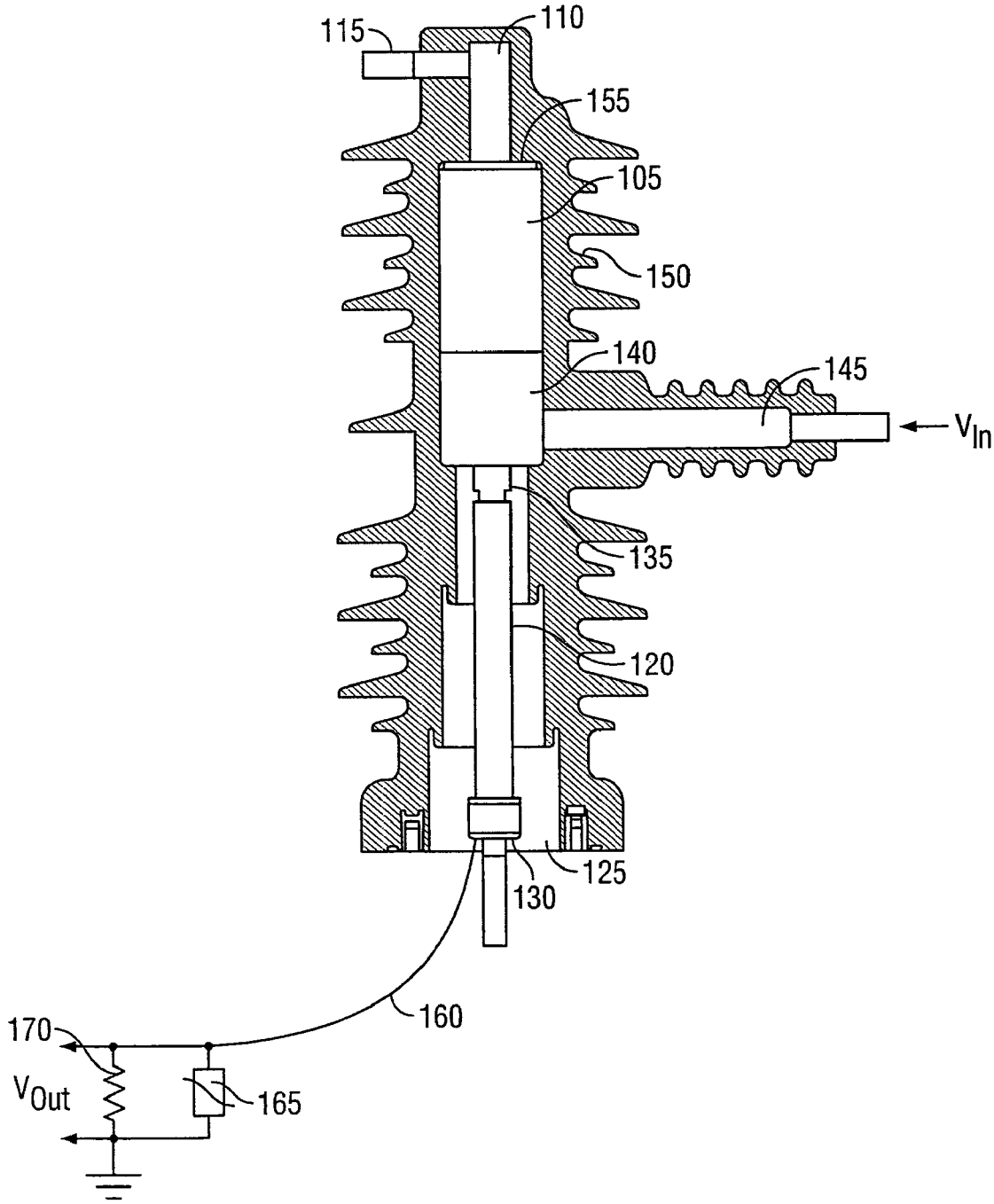
FIG. 1 is an illustration of a vacuum switching device.

Referring to FIG. 1, a vacuum switching device including a vacuum interrupter 105 that may be used to protect an external circuit (not shown) from excessively high current is illustrated. The vacuum interrupter 105 includes a stationary terminal rod 110 that is connected to an upper contact terminal 115. The upper contact terminal 115 allows a connection of the vacuum interrupter 105 to the external circuit.

The vacuum fault interrupter 105 is affixed to an operating rod 120 that is contained within a dielectric-filled cavity 125 (dielectric, not shown, may be gaseous or liquid) and extends through an opening 130. The operating rod 120 is connected to an external device (not shown) operable to cause axial movement thereof and to a movable electrical contact assembly 135 so as to move a movable electrical contact of the assembly 135 into or out of contact with a stationary electrical contact within the vacuum interrupter 105 (interior of vacuum interrupter not shown).

The movable electrical contact assembly 135 is instrumental in actuating a movement of an electrical contact within vacuum interrupter 105 to thereby interrupt a flow of current within vacuum interrupter 105.

A current interchange assembly 140 permits current flow between the moving electrical contact assembly 135 and a stationary conductor 145. In general, the assembly facilitates current flow between two points and may include, for example, a roller contact, a sliding contact, or a flexible connector.

A compliant material 150, which may be, for example, a silicone sleeve, encases the vacuum interrupter 105. In one implementation, the compliant material 150 is adhered to the vacuum interrupter 105 by, for example, a silane-based adhesive such as SILQUEST A-1100 silane (that is, gamma-aminopropyl triethoxysilane). A rigid encapsulation material 155, which may be, for example, an epoxy encapsulation material, is used to enclose the whole of the vacuum switching device of FIG. 1.

In one implementation, operating rod 120 is manufactured from a tube made from a high-rigidity, insulating, polymeric material. The polymeric-material tube may be a filament-wound, epoxy glass reinforced tube (i.e., a fiberglass tube), having an internal cavity. Space within this internal cavity may be used to hold one or more resistors, which may then be used as a resistive, high-voltage sensor. Around such resistors, a low viscosity, liquid polymer compound may be injected, and subsequently cured to assume a stable polymer state. In this implementation, one end of one of the resistors may be connected to the moving contact assembly 135. An end of another one of the resistors (or the same resistor) may be connected to a highly flexible wire 160, and through this wire to a parallel connection of an overvoltage protection device 165 and a low-arm resistor 170. Thus, in this implementation, the sensor output voltage Vout measured across the low-arm resistor 170 is equal to:

$$V_{out} = \frac{V_{in} \times R_{low-arm}}{R_{low-arm} + R_{operating-rod}} \quad (1)$$

In this way, a reliable, low-cost, easily-manufactured voltage sensor may be incorporated into the operating rod 120. Moreover, the elastic nature of the polymer compound greatly reduces an effect of mechanical impacts on the voltage sensors that result from motion and impacts associated with operation of operating rod 120. Details of the structure, operation, and assembly of the operating rod 120 are discussed below.

Figure 2:
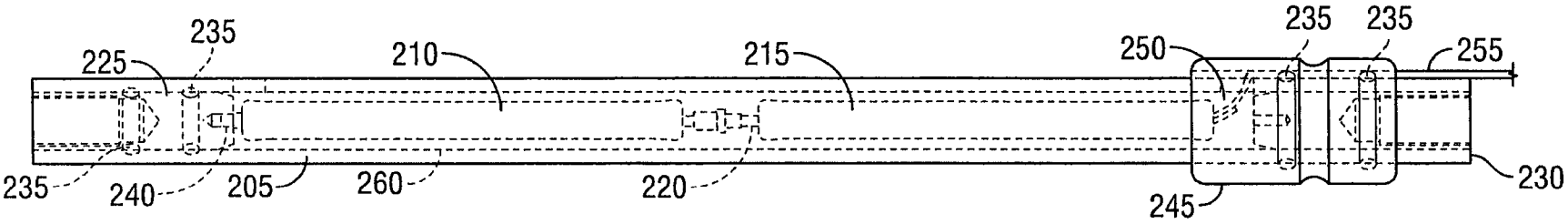
FIG. 2 is an illustration of an operating rod for use with the vacuum switching device of FIG. 1.

FIG. 2 is an illustration of one implementation of operating rod 120. In FIG. 2, a epoxy glass tube 205 is shown to house a first resistor 210 and a second resistor 215, the two resistors being connected by connector 220. Connector 220 may be, for example, a conventional wire connection, a pin socket assembly (discussed in more detail with respect to FIG. 3), or any other type of suitable connector.

A first fitting 225 and a second fitting 230 are metal pieces pre-fabricated to securely cap tube 205 while helping to provide an electrical contact to interior components of tube 205 and provide electrical connection to an outer conductive sleeve 245 (discussed below) through cross pins 235. Fittings 225 and 230 may be composed of, for example, steel. In one implementation, steel fittings 225 and 230 are knurled and press-fitted into the epoxy glass tube 205. The steel fittings 225 and 230 are further affixed to the tube 205 by inserting cross pins 235 through corresponding holes drilled in the tube 205 and fittings 225 and 230, as shown.

Such a process of press-fitting the steel fittings 225 and 230 into the inner diameter of the epoxy glass tube 205, and subsequent addition of cross pins 235 through the epoxy glass tube and end fittings, provides a high degree of mechanical strength at the connection of the steel fittings 225 and 230 to the epoxy glass tube 205. Such a strong and reliable mechanical joint is capable of transferring high impact forces from the steel fittings 225 and 230 to the epoxy glass tube 205, where such forces are expected due to the operation of the vacuum interrupter 105, as outlined above.

Moreover, the steel fittings 225 and 230 may be machined and pre-threaded for easy and reliable assembly to, respectively, the moving electrical contact assembly 135 (see FIG. 1) at the end of steel fitting 225 and the vacuum interrupter operating mechanism on the end of steel fitting 230. Thus, by directly connecting one end of resistor 210 to steel fitting 225 using, for example, a pin socket assembly 240, a direct connection between resistor 210 and stationary conductor 145 (see FIG. 1) is obtained simply by threading steel fitting 225 into a corresponding portion of the moving electrical contact assembly 135. In this way, an electrical contact is established which brings a high-voltage potential present on the stationary conductor 145 through the steel fitting 225 to the high-voltage resistor 210.

At the other end of epoxy glass tube 205, an electrical connection is made between a resistor lead 250 and a high elasticity wire 255. This connection may be made prior to inserting the resistor assembly into the epoxy glass tube 205, by means of, for example, a solder connection or a crimped splice connector. The highly elastic wire 255 is used to bring the voltage signal out of the epoxy glass tube through a slot (not shown) machined in the inner diameter of conductive sleeve 245. Fitting 230 is typically mechanically and electrically connected to a grounded mechanism linkage. Since sleeve 245 is electrically connected to fitting 230 through pins 235, sleeve 245 is thus electrically grounded as well. Alternatively, a separate ground lead (high elasticity wire) may be used to provide this ground connection.

Free space remaining within a cavity of epoxy glass tube 205 (that is, between the epoxy glass tube 205 and the resistors 210 and 215) is filled with an elastomeric compound 260. Compound 260 remains elastic over a relatively wide temperature range (for example, −50 to +100° C.), possesses high dielectric properties (for example, >400 volts/mil), and is cured to a high degree so as to have few, if any, voids. Compound 260 provides damping for mechanical/shock energy transferred through operating rod 120, and provides excellent bonding to all encapsulated parts, in particular, the epoxy glass tube 205 and the high-voltage resistors 210 and 215.

Figure 3:
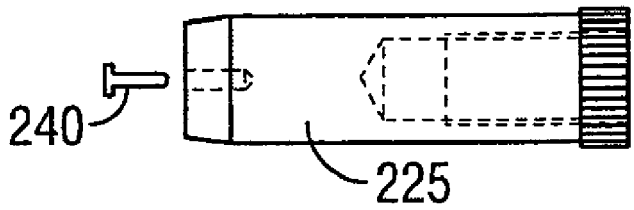
FIG. 3 is a more detailed illustration of a portion of the operating rod of FIG. 2.

FIG. 3 is a more detailed illustration of steel fitting 225, including an illustration of pin socket assembly 240. Specifically, pin socket assembly 240 is pressure-fitted to form an integral part of the steel fitting 225. As discussed in more detail below, pin socket 240 is used to establish good electrical contact between the steel fitting 225 and the high-voltage resistor 210. Moreover, use of pin socket assembly 240 simplifies assembly procedures, and provides sufficient elasticity (that is, in particular, freedom of movement for resistor 210) during a high mechanical impact operation of operating rod 120.

Figure 4:
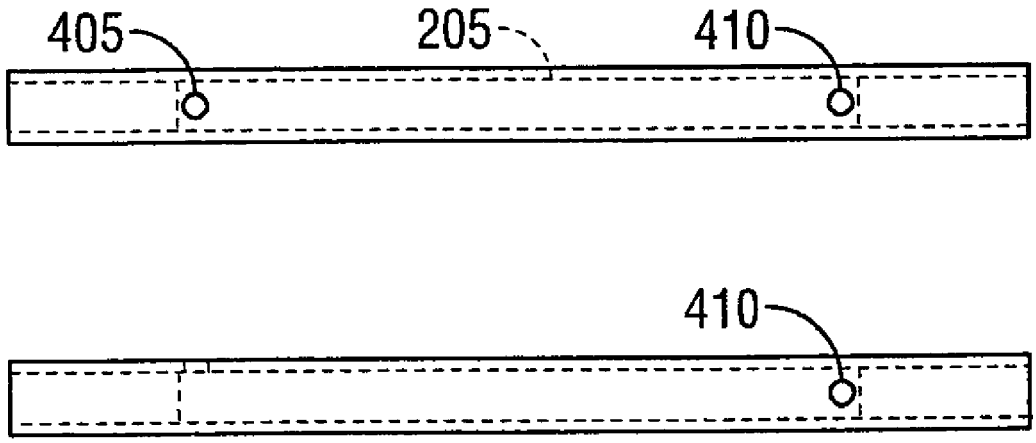
FIG. 4 is an illustration of a body of the operating rod of FIG. 2.

FIG. 4 is an illustration of epoxy glass tube 205. As shown in FIG. 4, a hole 405 is drilled through one side of epoxy glass tube 205 to permit insertion of compound 260. Similarly, a hole 410 is drilled through the opposite end of epoxy glass tube 205 for venting of air during filling of compound 260, and to permit high elasticity wire 255 to exit an inner diameter of the epoxy glass tube 205.

Figure 5:
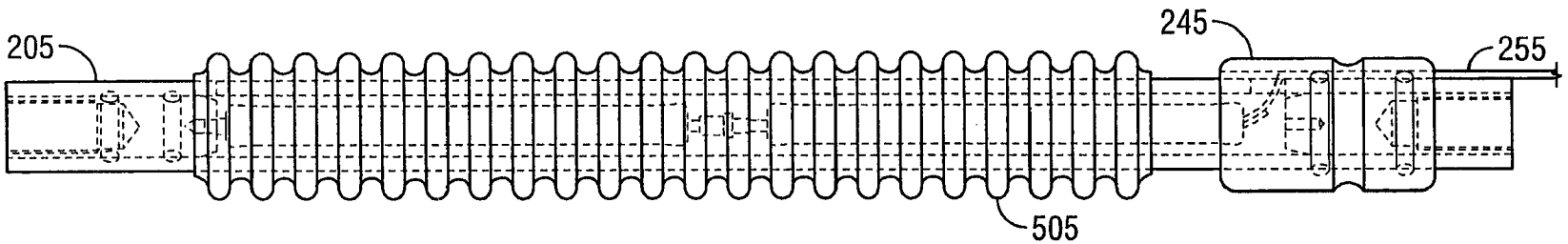
FIG. 5 is an illustration of the operating rod of FIG. 2 including an exterior rubber skirt.

FIG. 5 is an illustration of epoxy glass tube 205 covered by a silicone rubber skirt 505. As shown, circumferential ribs are included along the length of silicone rubber skirt 505 in order to increase the "creep distance" (length of insulating surface), and to thereby help prevent debilitating short circuits and generally improve dielectric properties of the tube 205 and associated elements. As shown in FIG. 5, the silicone rubber skirt 505 is affixed to the tube 205 using a room temperature vulcanizing ("RTV") silicone rubber-based adhesive.

The grounded sleeve 245 provides a function of "guarding" or "shielding" of any leakage current which may flow over the surface of the silicone skirt 505. This provides and maintains an accurate output of the voltage sensor, regardless of varying leakage current which may occur over surface of silicone skirt 505 (such as that expected during high humidity conditions or other deterioration of dielectric properties of silicone skirt 505 or its interface with the epoxy glass tube 205). The length of the sleeve 245 may be such that it covers the exit of elastic lead 255 and is able to conduct any leakage currents to ground.

Figure 6:
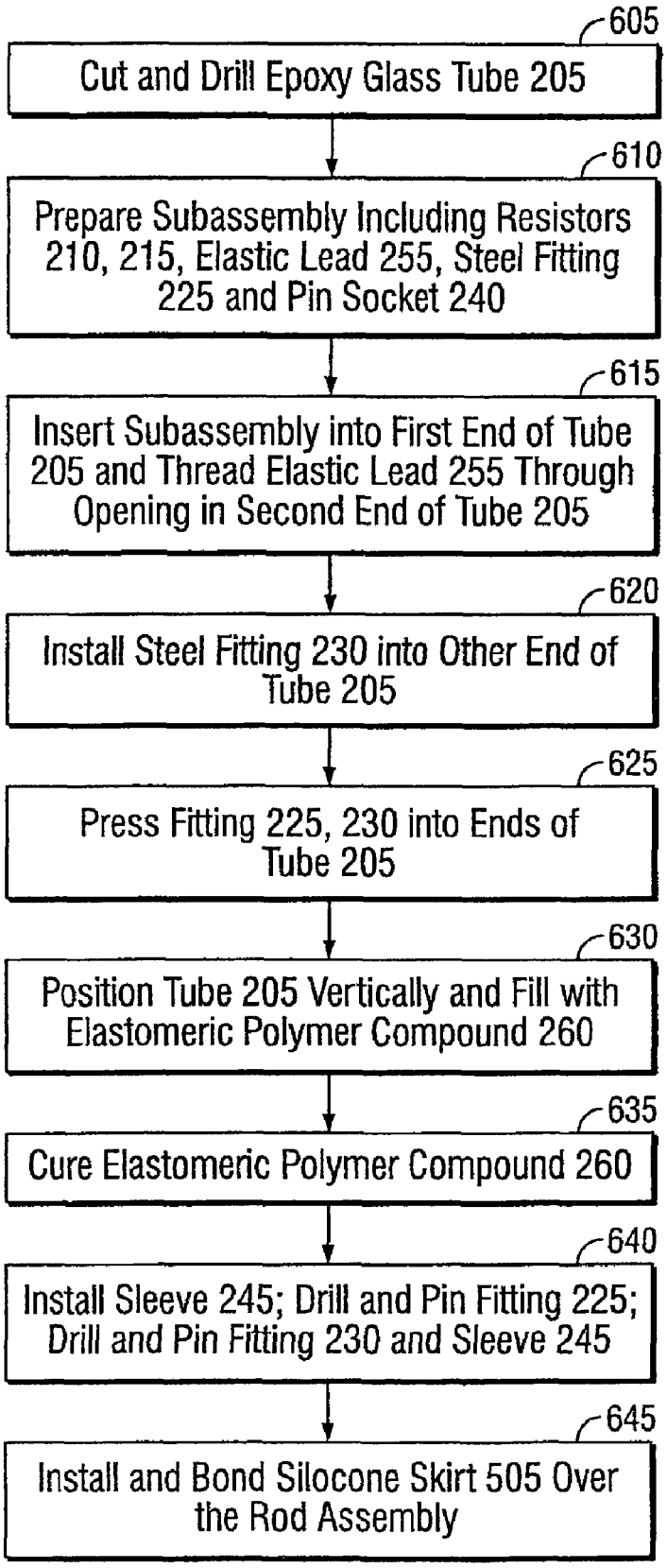
FIG. 6 is a flow chart illustrating methods for making the operating rod of FIG. 2.

FIG. 6 is a flow chart illustrating a procedure 600 for assembling operating rod 120. First, epoxy glass tube 205 is cut and drilled in the manner illustrated in FIG. 4 to form holes 405 and 410 (605). Subsequently, resistors 210 and 215 are assembled together with an elastic lead 255 and joined with steel fitting 225 and pin socket assembly 240 to form a sub-assembly (610).

The subassembly is inserted through a first end of the epoxy glass tube 205 and pushed through the length of the epoxy glass tube 205, such that an end of elastic wire 255 is pulled through hole 410 at the other end of the epoxy glass tube 205, and the steel fitting 225 is properly positioned at the first end (615).

Subsequently, the second steel fitting 230 is placed into the remaining end of the epoxy glass tube 205 (620). Next, the prefabricated steel fittings 225 and 230 are pressed into their respective ends of epoxy glass tube 205 (625).

The elastomeric compound 260 then is injected into the cavity of the epoxy glass tube 205 (630). In one technique, epoxy glass tube 205 is placed on its end, with steel fitting 225 on the bottom. By steadily injecting the polymer compound 260 into the lower end of epoxy glass tube 205 through hole 405, air within the cavity of epoxy glass tube 205 is pushed in an upward direction by the rising polymer compound 260. In this way, the cavity within epoxy glass tube 205 is completely filled. It should be understood that in this implementation, air being displaced by the rising polymer compound 260 is released through hole 410 in epoxy glass tube 205.

Thereafter, the polymer compound 260 is allowed to cure (635). If the technique for inserting the polymer compound 260 just described is followed, epoxy glass tube 205 may be left in the described upright position for the curing process to occur. Epoxy glass tube 205 having end fittings 225 and 230 already press-fitted into its respective ends then has sleeve 245 assembled, and both ends of tube 205 are drilled as necessary to include pins 235 (640). Finally, the silicone rubber skirt 505 is pulled over the entire assembly associated with the epoxy glass tube 205 (645).

In the above-described technique, the elastomeric compound 260 may be, for example, PolyButadiene (synthetic rubber), such as DolPhon CB1120 manufactured by the John C. Dolph Company of Monmouth Junction, N.J. Other materials may be used as elastomeric compound 260, such as silicone rubber, polyurethane, or silicone gel.

Implementations described above have various features. For example, the fact that the sensor is implemented within the operating rod 120, as opposed to outside of the operating rod (perhaps contained within an encapsulation material) allows for overall reduced dimension and ease of assembly of the assembly shown in FIG. 1, relative to conventional vacuum interrupter assemblies.

As another example, the implementations are relatively low in cost. In particular, epoxy glass tube 205 is easy to manufacture and very inexpensive. When radially-wound, such a epoxy glass tube is nonetheless very strong and reliable during operations, and is also very light in weight (which may allow for faster operation). Moreover, the epoxy glass material of epoxy glass tube 205 is resistant to the types of mechanical and thermal shock typically encountered during operation of vacuum interrupter 105.

Further resistance to mechanical shock during operation is provided by the elastomeric compound 260. Such a compound also offers a very low coefficient of thermal expansion over a wide range of operating temperatures. With the impact strength and low weight just described, implementations enable high speed interrupter operation with reduced contact bounce, and therefore increase interrupter lifetime and reliability. Moreover, implementations described have a straight forward and easily-implemented manufacturing process, and a relatively small part count. Also, the elastomeric compound that carries the mechanical forces around the centrally positioned resistors 210 and 215 has a high degree of thermal matching with respect to the resistors.

Finally, it should be understood that, although the above description has largely been provided in terms of vacuum interrupters, the features described above may be equally applicable in any high-powered, vacuum-based switching device, and in various other settings, such as use of this type of operating rod in a fluid-filled cavity 125. Possible fluids include insulating oil, SF6, and/or air.

A number of implementations have been described. Nevertheless, it will be understood that various modifications may be made. Accordingly, other implementations are within the scope of the following claims.

What is claimed is:

1. A method for making an operating rod for use in a vacuum switching device, the method comprising:

inserting a sensor into a hollow tube;

electrically connecting a first portion of the sensor to a first end fitting attached to a first end of the hollow tube by securing the first end fitting in the first end of the hollow tube and by attaching an end of the sensor to a pin socket assembly that allows movement of the sensor and is attached to the first end fitting;

connecting a second portion of the sensor to an electrical connection extending outside of the hollow tube at a second end of the hollow tube;

securing a second end fitting into the second end of the hollow tube; and injecting an elastic filling compound into the hollow tube, the filling compound being configured to hold the sensor within the hollow tube and to dampen mechanical energy transferred through the hollow tube upon mechanical impact.

2. The method of claim 1 wherein the filling compound is an elastomeric polymer compound.

3. The method of claim 1 wherein inserting a sensor comprises threading a resistive element through a length of the hollow tube.

4. The method of claim 3 further comprising attaching one end of the resistive element to the pin socket assembly attached to the first end fitting.

5. The method of claim 1 wherein inserting a sensor comprises:

drilling at least one hole through a portion of the tube near the first end of the tube;

press-fitting the first end fitting into the first end of the tube; and inserting a pin through the hole and into the first end fitting.

6. The method of claim 1 further comprising pulling a ribbed rubber skirt over the operating rod.

7. The method of claim 6, wherein pulling the ribbed rubber skirt over the operating rod comprises using a room temperature vulcanizing adhesive to affix the ribbed rubber skirt to the operating rod.

8. The method of claim 1 wherein the tube is a radially-wound epoxy glass tube.

9. The method of claim 1 wherein injecting the elastic filling compound into the tube further comprises:

drilling a hole in the tube near the second end of the tube;

positioning the tube with the first end below the second end; and injecting the filling compound at a point near the first end, such that air displaced by the filling compound is removed from the tube through the hole near the second end of the tube.

10. The method of claim 1 further comprising electrically connecting an outer conductive sleeve to the second end fitting and electrically grounding the conductive sleeve.

11. The method of claim 10 wherein securing the second end fitting comprises inserting a pin through a hole in a second end of the tube, the second end fitting, and the outer conductive sleeve.

12. The method of claim 1 wherein the first end fitting is secured in the first end of the hollow tube by press fitting the first end fitting into the first end of the hollow tube.

13. The method of claim 1 wherein the sensor comprises a first resistive element and a second resistive element, and the pin socket assembly is attached to the first resistive element to allow movement of the first resistive element.

14. The method of claim 13 wherein the first resistive element and the second resistive element are connected by a second pin socket assembly.

15. The method of claim 1 wherein attaching the end of the sensor to the pin socket assembly allows movement of the sensor during operation of the operating rod.

16. A method for making a vacuum switching device, the method comprising:

inserting a sensor into a hollow tube;

electrically connecting a first portion of the sensor to a first end fitting attached to a first end of the hollow tube by securing the first end fitting in the first end of the hollow tube and by attaching an end of the sensor to a pin socket assembly that allows movement of the sensor and is attached to the first end fitting;

connecting a second portion of the sensor to an electrical connection extending outside of the hollow tube at a second end of the hollow tube;

securing a second end fitting into the second end of the hollow tube; and injecting an elastic filling compound into the hollow tube, the filling compound being configured to hold the sensor within the hollow tube and to dampen mechanical energy from transferring through the hollow tube upon mechanical impact.

17. The method of claim 16 further comprising:

connecting the first end fitting to a moving electrical contact assembly; and connecting the second end fitting to a vacuum interrupter operating mechanism.

18. The method of claim 16 further comprising electrically connecting the electrical connection to an overvoltage protection device and connecting the overvoltage protection device to a low-arm resistor.

19. The method of claim 16, wherein the first end fitting is secured in the first end of the hollow tube by press fitting the first end fitting into the first end of the hollow tube.

20. A method for making an operating rod for use in a vacuum switching device, the method comprising:

inserting a sensor into a hollow tube;

electrically connecting a first portion of the sensor to a first end fitting attached to a first end of the hollow tube by securing the first end fitting in the first end of the hollow tube and by attaching an end of the sensor to a pin socket assembly attached to the first end fitting;

connecting a second portion of the sensor to an electrical connection extending outside of the hollow tube at a second end of the hollow tube;

securing a second end fitting into the second end of the hollow tube; and filling the hollow tube with a filling compound to hold the sensor within the hollow tube, wherein inserting the sensor comprises:

drilling at least one hole through a portion of the tube near the first end of the tube, press-fitting the first end fitting into the first end of the tube, and inserting a pin through the hole and into the first end fitting.

21. A method for making an operating rod for use in a vacuum switching device, the method comprising:

inserting a sensor into a hollow tube;

electrically connecting a first portion of the sensor to a first end fitting attached to a first end of the hollow tube by securing the first end fitting in the first end of the hollow tube and by attaching an end of the sensor to a pin socket assembly attached to the first end fitting;

connecting a second portion of the sensor to an electrical connection extending outside of the hollow tube at a second end of the hollow tube;

securing a second end fitting into the second end of the hollow tube; and filling the hollow tube with a filling compound to hold the sensor within the hollow tube, wherein filling the tube with the filling compound further comprises:

drilling a hole in the tube near the second end of the tube;

positioning the tube with the first end below the second end; and injecting the filling compound at a point near the first end, such that air displaced by the filling compound is removed from the tube through the hole near the second end of the tube.

22. The method of claim 21 wherein the hole is used to facilitate forming the electrical connection to the second portion of the sensor.

* * * * *